US008893938B2

(12) United States Patent
Grossenbacher et al.

(10) Patent No.: US 8,893,938 B2
(45) Date of Patent: Nov. 25, 2014

(54) SYSTEM FOR ADJUSTING THE LENGTH OF A BRACELET OR STRAP

(75) Inventors: Pascal Grossenbacher, Neuchâtel (CH); Jean-François Dionne, Kerzers (CH); Yves Winkler, Schmitten (CH); Jean-Jacques Born, Morges (CH); Erik Jan Frenkel, Neuchâtel (CH)

(73) Assignee: The Swatch Group Research and Development Ltd, Marin (CH)

( * ) Notice: Subject to any disclaimer, the term of this patent is extended or adjusted under 35 U.S.C. 154(b) by 339 days.

(21) Appl. No.: 12/913,282

(22) Filed: Oct. 27, 2010

(65) Prior Publication Data

US 2011/0099771 A1 May 5, 2011

(30) Foreign Application Priority Data

Oct. 29, 2009 (EP) ..... 09174428

(51) Int. Cl.

| | |
|---|---|
| ***A44C 5/14*** | (2006.01) |
| ***A44C 5/22*** | (2006.01) |
| ***G04B 37/14*** | (2006.01) |

(52) U.S. Cl.

CPC ... *A44C 5/14* (2013.01); *A44C 5/22* (2013.01); *G04B 37/1486* (2013.01)

USPC ..... 224/167; 224/175; 224/267; 368/281; 368/282

(58) Field of Classification Search

CPC ..... A44C 5/14

USPC ..... 224/167, 171, 175, 267; 368/282, 281

See application file for complete search history.

(56) References Cited

U.S. PATENT DOCUMENTS 1,219,449 A * 3/1917 Fitch ..... 224/170

FOREIGN PATENT DOCUMENTS

| | | |
|---|---|---|
| EP | 1 588 640 | 10/2005 |
| FR | 935 435 | 6/1948 |
| FR | 2 754 615 | 4/1998 |
| WO | 03/039287 | 5/2003 |

OTHER PUBLICATIONS

European Search Report issued in corresponding application No. EP09174428, completed Apr. 7, 2010.

Strand, Merriam-Webster.com (2013), available at http://www.merriam-webster.com/dictionary/strand (downloaded Dec. 30, 2013 at 7:51pm).

* cited by examiner

*Primary Examiner* — Jack W Lavinder

(74) *Attorney, Agent, or Firm* — Griffin & Szipl, P.C.

(57) ABSTRACT

The present invention concerns a portable object (1). This portable object includes a case (2) to which a bracelet or strap (3) is fixed taking the form of two bracelet or strap strands. The portable object is characterized in that at least one of the bracelet or strap strands is moveably mounted to slide relative to the case so that the length of the bracelet or strap can be adjusted.

15 Claims, 5 Drawing Sheets

SYSTEM FOR ADJUSTING THE LENGTH OF A BRACELET OR STRAP

This application claims priority from European Patent Application No. 09174428.4 filed Oct. 29, 2009, the entire disclosure of which is incorporated herein by reference.

The present invention generally concerns a portable object including a case to which a bracelet or strap, in the form of two bracelet or strap strands, is fixed.

BACKGROUND OF THE INVENTION

It is known in the prior art that wristwatches are fixed to the user's wrist via a leather or rubber strap or metal bracelet, said strap or bracelet being formed of two strands. The watch case thus includes two pairs of horns diametrically opposite each other. The two strands of the strap or bracelet are then fixed to the watch case via the two pairs of horns. The two strap or bracelet strands are secured to each other by a clasp enabling the wristwatch to be attached to the user's wrist.

One drawback of this type of strap or bracelet is the lack of freedom to adjust the length thereof. Indeed, metal bracelets are formed of links which are removed or added to adjust the length of said bracelet. Since the links have a fixed size, adjustment to the exact dimension of the wrist is not always possible. As regards leather or rubber straps, these are pierced with holes so that a tongue can slide therein. The number of holes is limited if one wishes to avoid making the strap fragile. Indeed, too many holes would mean a small space between each hole and thus greater fragility of the strap in this respect. If the space between two holes breaks, the holes become unusable. No means exist for finely adjusting the length of the bracelet or strap, which can be inconvenient for the user.

Another drawback of these bracelets and straps is that their length cannot be adjusted in accordance with the environment and particularly in accordance with the temperature. It has been shown that the physiognomy of a person's body can vary depending upon the environment in which the person is situated. One of the environmental elements that has an effect on the human physiognomy is temperature. Thus, a person's limbs tend to contract when the person feels cold and, conversely, said person's limbs tend to expand when he or she feels hot. Consequently, the wearer's wrist expands or contracts with temperature, which means that the diameter of the wrist varies with temperature. Although with a leather or rubber strap, it is possible to tighten or loosen the strap, this is not the case with a metal bracelet. The size of the bracelet cannot therefore be adjusted with temperature.

Thus, the user finds him or herself with a bracelet, which, at the ambient temperature fits the user's wrist, but which will be too long when the user is cold and too short when the user is hot, thus causing inconvenience.

SUMMARY OF THE INVENTION

The invention concerns a portable object which overcomes the drawbacks of the prior art by providing a portable object whose bracelet or strap length can be finely adjusted and which adapts to changes in the human physiognomy with temperature.

The invention therefore concerns a portable object including a case to which a bracelet or strap is fixed taking the form of two bracelet of strap strands, the two bracelet or strap strands being fixed to said case via two pairs of horns. The portable object is characterized in that at least one of the two pairs of horns is moveably mounted to slide relative to the case so that the bracelet or strap length can be adjusted.

A first advantage of the portable object according to the present invention is that it allows the bracelet length to be altered simply. Indeed, as soon as one or other of the bracelet or strap strands is capable of moving by sliding relative to the case, it is possible for the user to vary the length of the bracelet or strap without having to remove said portable object from his or her wrist.

Advantageous embodiments of the portable object form the subject of the dependent claims 2 to 15.

A first advantage of these embodiments is that they allow the bracelet or strap length to be adjusted with temperature. The portable object includes a control unit that controls the sliding of at least one bracelet or strap strand relative to the portable object. This control unit may include a temperature sensor. The temperature sensor will control adjustment of the bracelet or strap length in accordance with the measured temperature, enabling the bracelet or strap to be lengthened when the temperature increases relative to a reference temperature, and shortened when the temperature decreases relative to a reference temperature.

A second advantage is the flexibility of the system. Indeed, although the adjustment system may be automatic, controlled by temperature, it may also be designed so that adjustment is controlled by the user. In such case, the adjustment system becomes useful for finer adjustment of the bracelet or strap size.

The present invention also concerns two methods of adjusting the bracelet or strap of a portable object with the following steps:

- measuring the temperature;
- comparing the measured temperature to an upper temperature threshold and a lower temperature threshold;
- increasing the length of the bracelet if the measured temperature is higher than the upper threshold or reducing the length of the bracelet if the measured temperature is lower than the lower threshold.

These methods are characterized respectively in that the bracelet or strap is returned to an initial position when the measured temperature falls below the upper threshold again or rises above the lower threshold or in that the bracelet is returned to an initial position when the measured temperature reaches a reference temperature.

BRIEF DESCRIPTION OF THE DRAWINGS

The objects, advantages and features of the portable object will appear more clearly in the following detailed description of at least one embodiment of the invention given solely by way of non-limiting example and illustrated by the annexed drawings, in which.

DETAILED DESCRIPTION

In the following description, all those parts of the portable object that are well known to those skilled in this technical field will only be explained in a simplified manner.

Figure 1:
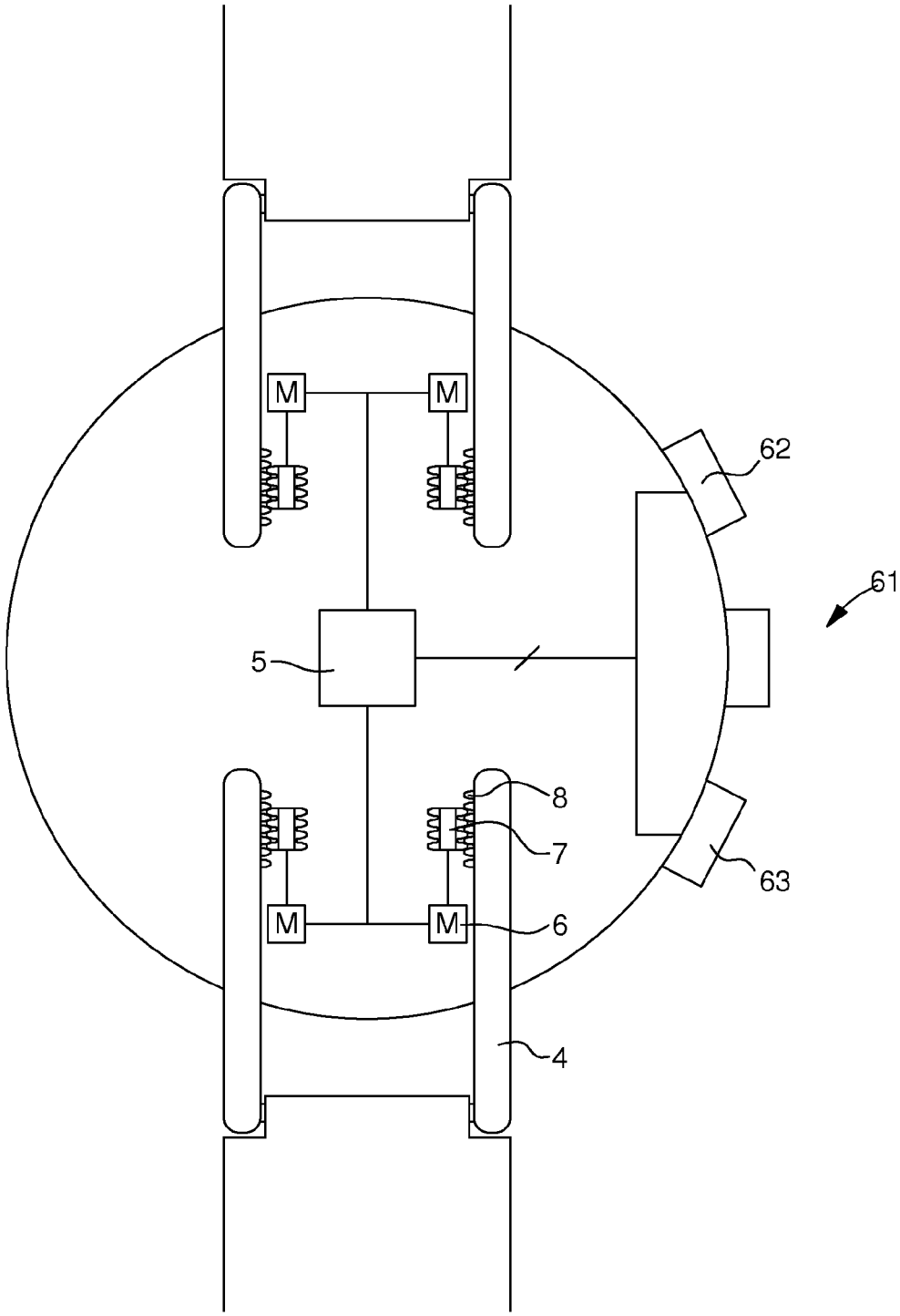
FIG. 1 shows schematically a partial view of a first embodiment of the portable object according to the present invention.
Figure 2:
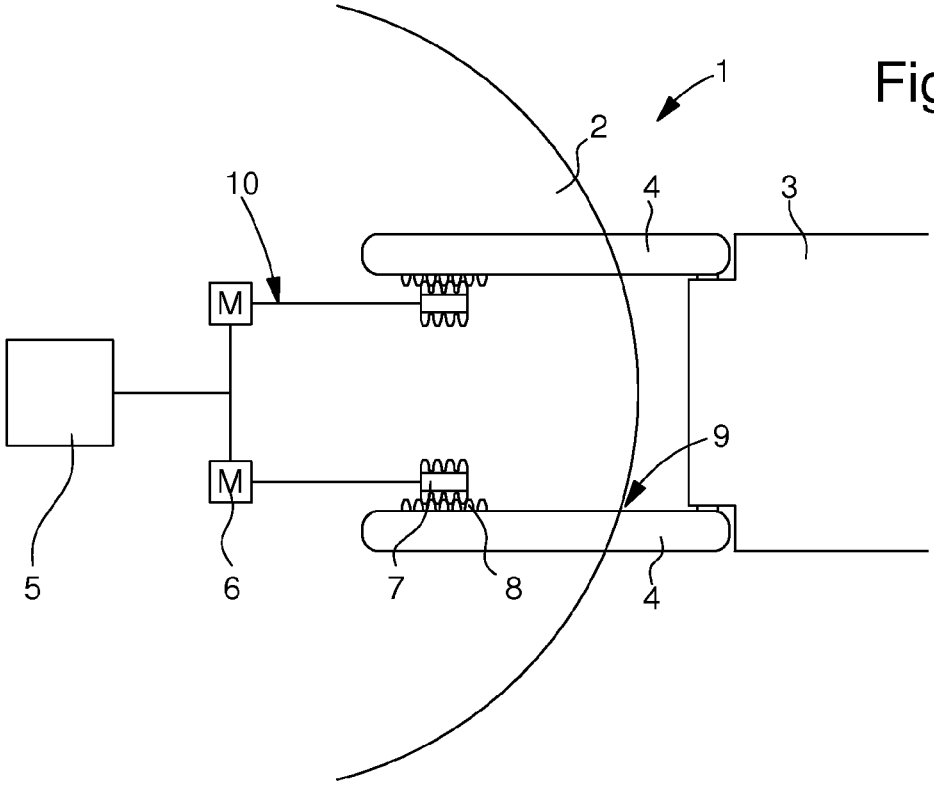
FIG. 2 shows schematically a second embodiment of the portable object according to the present invention.

FIG. 1 shows schematically a partial view of portable object 1 according to the present invention. This portable object 1 can be a watch or any other apparatus worn on the wrist such as a cardiac-frequency meter, a pedometer or suchlike. Portable object 1 includes a case 2 containing the constituent elements of the watch. Portable object 1 is fixed to the user's wrist via a bracelet or strap formed of two bracelet or strap strands 3. Bracelet or strap strands 3 are fixed to case 2 via horns 4 and connected to each other via a clasp of the type with a tongue or unfolding buckle. Of course, it will be clear that the bracelet or strap may comprise a single strand 3 secured to case 2 by each of the ends thereof, said bracelet being of the flexible type.

These bracelet or strap strands 3 may be made of steel, rubber or leather for example. If the bracelet strands 3 are made of steel, an unfolding buckle type clasp is used and the bracelet is adjusted by adding or removing links from said bracelet strands 3. If strap strands 3 are made of leather or rubber, adjustment is carried out via holes made in one of strands 3.

In this case, the bracelet cannot be adjusted to the user's wrist in an optimum manner. In order to overcome this problem, the present invention proposes the following solution.

In a first embodiment, horns 4 are slidably mounted in case 2. The case thus has orifices 9, whose dimensions are such that they enable said horns 4 to be inserted and to slide. These horns 4 take the form of a longitudinal element of the parallelepiped type, each horn 4 including means enabling bracelet or strap strands 3 to be fixed to said horns 4. Each horn 4 further includes a toothing 8 at the end thereof located inside case 2. This toothing 8 is used for cooperating with a gear 7. The length of toothing 8 allows the desired adjustment amplitude, for example of approximately 5 mm. Of course, it will be clear that this amplitude is not limiting and that it is for the manufacturer to determine the adjustment amplitude.

When set in rotation about its longitudinal axis in a positive direction, this gear 7 sets horn 4 in motion via toothing 8 so that horn 4 moves inside case 2. Conversely, when gear 7 is set in rotation about its longitudinal axis in a negative direction, horn 4 is set in motion via toothing 8 so that horn 4 moves outside case 2. Preferably, horns 4 are provided with stop means for limiting the movement of horns 4 so that gears 7 always cooperate with toothings 8. One may envisage the stop means taking the form of projecting portions arranged on the horns, for example at the ends thereof.

Each gear 7 is actuated by an electric motor 6 via a transmission shaft 10. Portable object 1 further includes a control unit 5, which controls motors 6. This control unit 5 is capable of sending signals to motors 6 so as to control the direction of rotation of motors 6 and thus gears 7.

So that the user can adjust the size of the bracelet or strap of portable object 1 to the size of his or her wrist, the portable object includes, as shown in FIG. 1, interface means 61, accessible from the exterior by the user. According to the example of FIG. 1, the interface means includes two push-buttons 62, 63, the first 62 of which allows horns 4 to move towards the interior of case 2 and the second 63 allows horns 4 to move towards the exterior of case 2, these push-buttons 62, 63 being connected to control unit 5 via connection wires. Thus, when one or other of buttons 62, 63 is pressed, an electric signal is sent to control unit 5, which will then operate motors 6 of horns 4.

According to a second embodiment of the present invention, the bracelet can adapt to the temperature so as to follow fluctuations in the size of the user's wrist with temperature. To achieve this, control unit 5 includes at least one temperature sensor that may be of the piezoelectric type or another type.

The temperature sensor is thus used to measure a temperature value which will be sent to said control unit 5. This control unit 5 will then control the movement of horns 4, according to a defined control programme, in accordance with this temperature data.

Figure 7A:
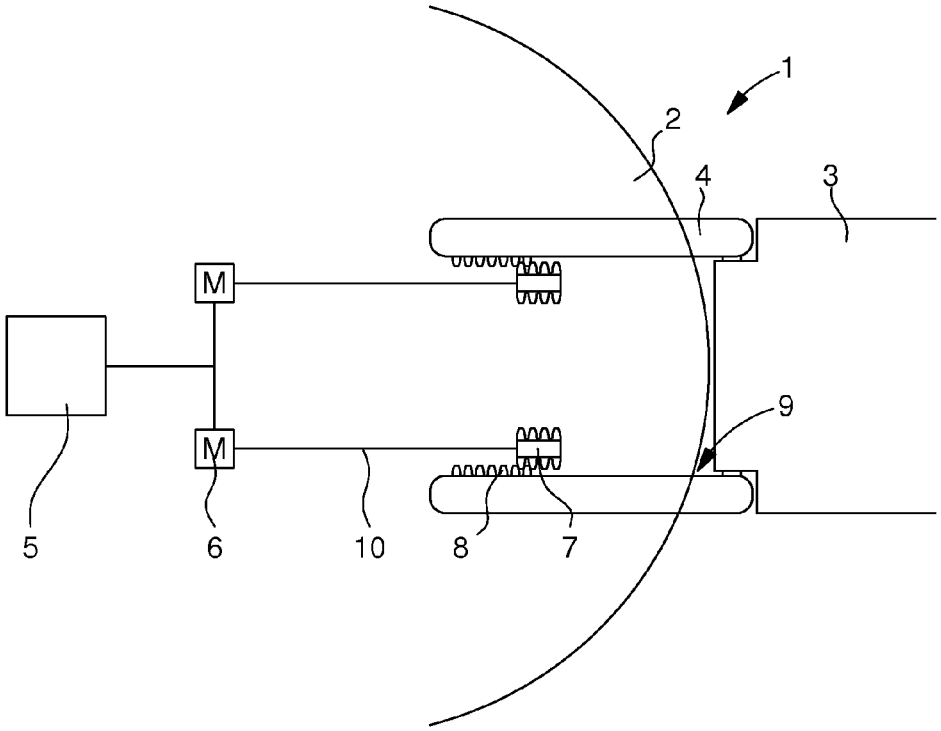
FIGS. 7*a* to 7*c* show schematically a partial view of the second embodiment of the portable object according to the present invention in different positions.
Figure 7B:
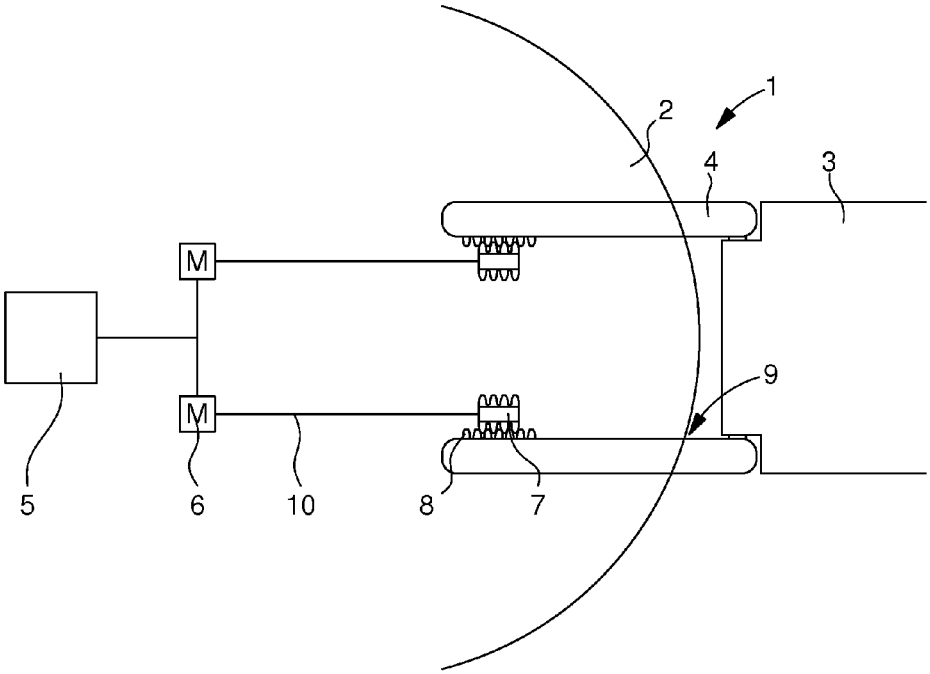
Figure 7C:
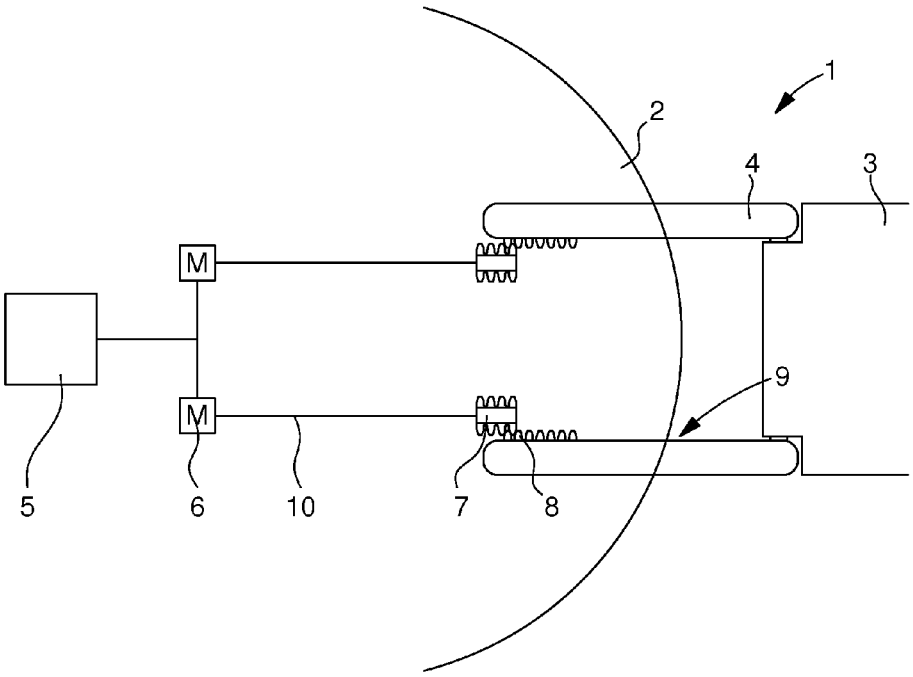

According to a first operating principle, the control programme implemented in control unit 5 uses levels. This operating principle, shown in FIGS. 7*a*, 7*b* and 7*c* is simple and does not use much energy. To achieve this, the programme defines different stages, at least three, so as to control the variation in bracelet length. The first level called TempCons is a reference temperature. The second level is called TempMin and is the temperature from which the wrist size decreases because the organism contracts in response to the cold. The third level is called TempMax and is the temperature from which the wrist size increases because the organism expands in response to heat. For example, the TempCons level can be set at value of 20° C., the TempMin level at a value of 10° C. and the TempMax level at a value of 30° C.

Thus, at temperature TempCons, portable object 1 is in a normal position as shown in FIG. 7*b*. Horns 4 are thus slightly protruding so that they can be moved either in the direction of the case or in the opposite direction.

When the temperature is increasing, at the moment when the temperature sensor measures that the temperature has reached the TempMax value, control unit 5 acts by adjusting bracelet or strap strands 3. Horns 4 on which bracelet or strap strands 3 are fixed are then set in motion in a direction which goes towards the exterior of case 2 as in FIG. 7*c*. The bracelet length is thus increased in accordance with a predefined variation.

Indeed, it is assumed that the circumference of a person's wrist varies by 5 mm between the state in which the wrist is contracted and the state in which the wrist is expanded. This means overall that between temperature value TempCons and value TempMax, the circumference of the wrist varies by 2.5 mm. This variation is then the same between temperature value TempCons and value TempMin. Given that the variation is achieved by moving the two bracelet or strap strands 3, the movement of each bracelet or strap strand 3 is considered to be 1.25 mm. Of course, it is possible for only one bracelet or strap strand 3 to move and in such case, the latter must be capable of moving over the entire defined amplitude of movement.

Conversely, when the temperature is decreasing, at the moment when the temperature sensor measures that the temperature is less than TempMin, control unit 5 acts by adjusting bracelet or strap strands 3. Horns 4 on which these bracelet or strap strands 3 are fixed are then set in motion in a direction which goes towards the inside of case 2 as shown in FIG. 7*a*.

As regards transitions between temperature TempMax and temperature TempMin, there are two possible cases.

In a first case, the bracelet is considered to return to its initial shape when the temperature measured by the sensor is within the temperature gap between TempMin and TempMax where both temperatures TempMin and TempMax are excluded. Thus, as soon as the temperature falls below TempMax or rises above TempMin, control unit 5 acts on horns 4 so that the latter return to their initial position.

In a second case, the return to the initial position of FIG. 7*b* occurs when the measured temperature reaches the value TempCons. Thus, if the temperature is higher than temperature TempMax, horns 4 will only return to their initial position when the temperature falls to reach threshold TempCons. Likewise, if the temperature is lower than temperature TempMin, horns 4 will only return to their initial position when the temperature increases to reach TempCons. This mode of operation proves very efficient and consumes less energy since small temperature variations due to a change from one place to another such as moving from a place exposed to the sun to a shady place does not cause a variation in the bracelet or strap size. Of course, it will be clear that intermediate thresholds can be integrated so that the bracelet size variation is more gradual.

According to a second operating principle, adjustment of the bracelet size is continuously carried out. To achieve this, a value chart is stored in portable object 1. This chart contains data on bracelet size variation with temperature. This therefore allows continuous adjustment of the bracelet size with temperature. Of course, the chart including data on bracelet size variation with temperature is not set and can be adapted to have a higher or lower number of adjustment positions.

It will be clear that the function of adjusting the bracelet size to that of the user's wrist with temperature is an independent function. Thus, this function can be added to the function of finely adjusting the bracelet size at the user's request. Said portable object 1 may only include this function of adjusting the bracelet size in accordance with temperature.

Figure 3:
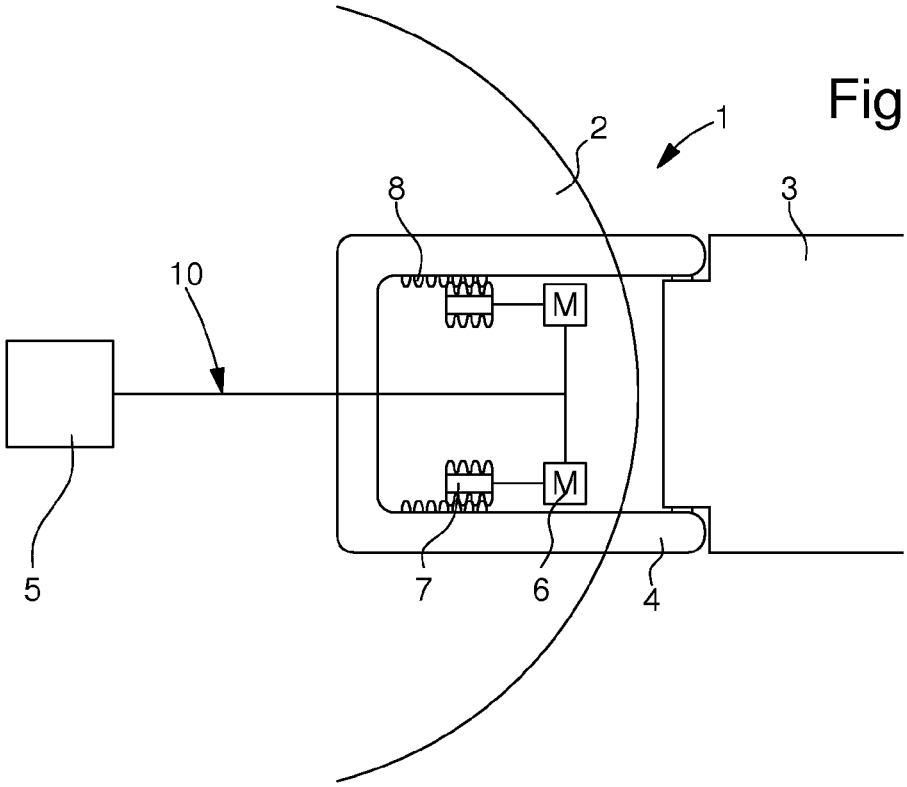
FIG. 3 shows schematically a partial view of a first variant of one or other of the two embodiments of the portable object according to the present invention.

In a first variant of one or other of the two embodiments of the present invention shown in FIG. 3, the horns 4 fixed to the same bracelet or strap strand 3 are integral with each other. Consequently, horns 4 fixed to the same bracelet or strap strand 3 then take the form of a U-shaped part 41. This U-shaped part 41 allows horns 4, which hold the same bracelet or strap strand 3 to always stay in exactly the same position relative to each other. This prevents one horn 4 moving further than the other and interfering with alignment and causing damage. Toothings 8 cooperating with gears 7 are located on each of the parallel branches forming said U-shaped part 41.

Figure 4:
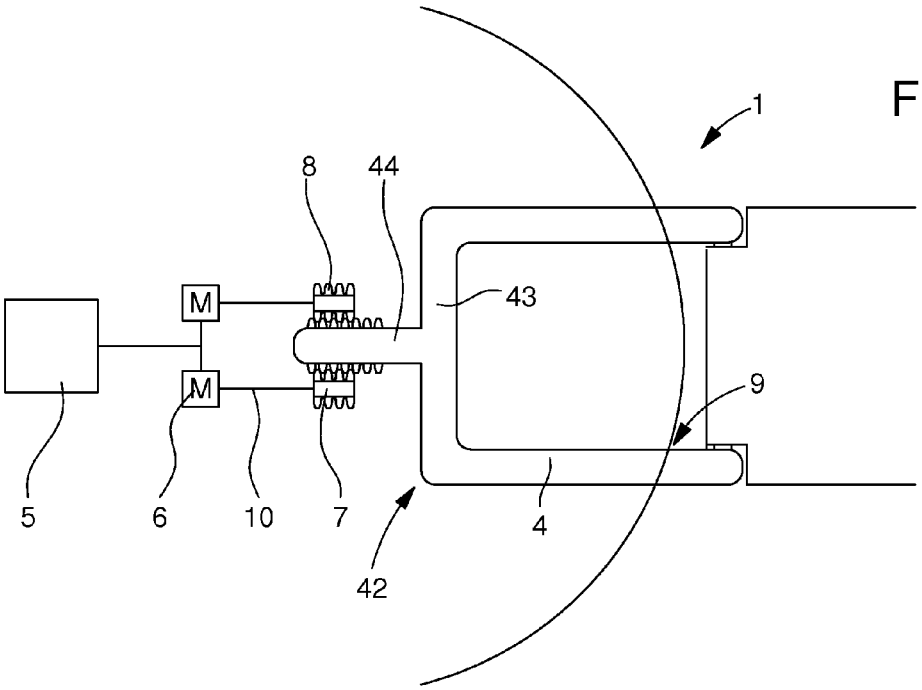
FIGS. 4, 5 and 6 show schematically a partial view of alternatives of the second variant of one or other of the two embodiments of the portable object according to the present invention.
Figure 5:
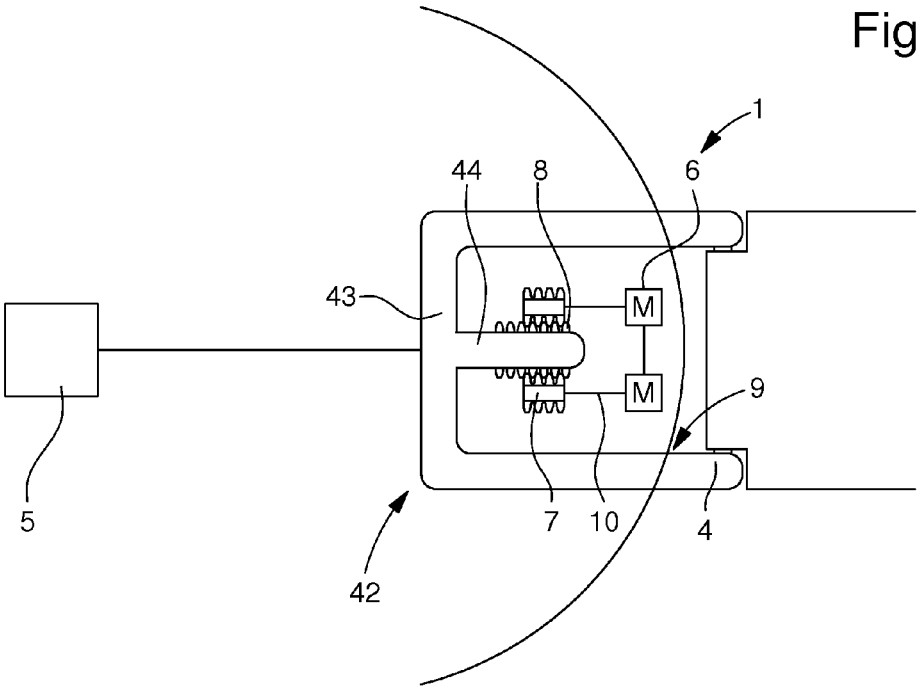
Figure 6:
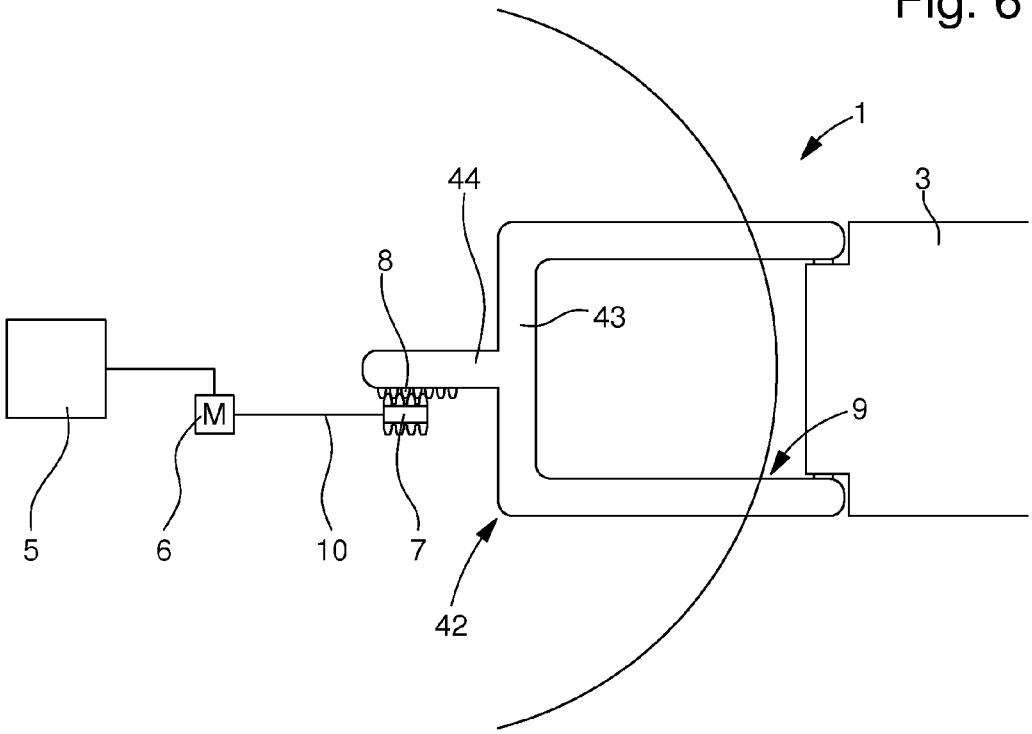

In a second variant of one or other of the two embodiments of the present invention shown in FIGS. 4, 5 and 6, horns 4 which hold a bracelet or strap strand 3 take the form of a U-shaped part 42 whose base 43 includes a projecting element 44 to give part 42 the shape of a tuning fork. This element 44 takes the form of a pin extending either towards the exterior of case 2 as in FIG. 5, or towards the inside of case 2 as in FIGS. 4 and 6. This element 44 is thus used for carrying toothings 8.

In a first alternative of this second variant, element 44 has two toothings 8, each cooperating with a gear 7 and a motor 6.

In a second alternative of this second variant, element 44 includes a toothing 8 cooperating with a gear 7 and a motor 6. There is thus a single motor for driving one pair of horns 4. This alternative reduces the number of motors 6 in case 2 and thus, consequently, reduces electric power consumption and the space taken by the system.

It will be clear that various alterations and/or improvements and/or combinations evident to those skilled in the art can be made to the various embodiments of the invention explained above without departing from the scope of the invention defined by the annexed claims.

It will be clear that portable object 1 may include two temperature sensors, the temperature value used for adjusting the bracelet length being the average temperature measured by these two sensors.

What is claimed is:

1. A portable object comprising:

(a) a case;

(b) two pairs of horns directly mounted in the case; and (c) a bracelet or strap taking the form of, respectively, two bracelet strands or two strap strands, wherein the two bracelet or strap strands are fixed to the case via the two pairs of horns, wherein at least one of the two pairs of horns is moveably mounted to slide relative to the case so that the bracelet or strap length can be adjusted.

2. The portable object according to claim 1, wherein it includes a control unit including at least one temperature sensor capable of measuring the ambient temperature, the control unit controlling the movement of the bracelet or strap strand or strands relative to the case of the portable object in accordance with the measured temperature value so as to adapt the bracelet or strap length.

3. The portable object according to claim 2, wherein it includes a control unit that can be controlled by the user from outside the case of the portable object and enabling the user to adjust the bracelet or strap length by moving the bracelet or strap strands relative to the case of the portable object.

4. The portable object according to claim 2, wherein the control unit further includes a memory zone in which are stored at least two temperature thresholds in addition to a reference temperature and wherein the control unit acts on the motors as soon as the measured temperature reaches one of said thresholds.

5. The portable object according to claim 2, wherein the control unit further includes a memory zone in which a temperature chart is stored so that the bracelet or strap adjustment can be continuous.

6. The portable object according to claim 2, wherein the control unit includes at least two temperature sensors and in that the temperature used is the average of the at least two temperatures provided.

7. The portable object according to claim 1, wherein the amplitude of movement of the horns with temperature is 5 mm.

8. A portable object comprising:

(a) a case;

(b) two pairs of horns directly mounted in the case;

(c) a bracelet or strap taking the form of, respectively, two bracelet strands or two strap strands, wherein the two bracelet strands or two strap strands are fixed to the case via the two pairs of horns, wherein at least one of the two pairs of horns is moveably mounted to slide relative to the case so that the bracelet or strap length can be adjusted; and (d) a control unit that can be controlled by a user from outside the case of the portable object, wherein the control unit enables the user to adjust the bracelet or strap length by moving the bracelet or strap strands relative to the case of the portable object.

9. A portable object comprising:

(a) a case;

(b) two pairs of horns directly mounted in the case; and (c) a bracelet or strap taking the form of, respectively, two bracelet strands or two strap strands, wherein the two bracelet strands or two strap strands are fixed to the case via the two pairs of horns, wherein at least one of the two pairs of horns is moveably mounted to slide relative to the case so that the bracelet or strap length can be adjusted, wherein the case includes orifices at the location of the horns so that the horns can slide into the case, and wherein each pair of horns includes at least one toothing so as to cooperate with a gear driven by a motor installed inside the case such that the horns penetrate the case to a greater or lesser extent, to tighten or loosen the bracelet or strap.

10. The portable object according to claim 9, wherein the horns of the same pair are integral with each other so as to form a U-shaped part.

11. The portable object according to claim 10, wherein each pair of horns includes two toothings each located on one of the branches of the part.

12. The portable object according to claim 9, wherein the horns of the same pair are integral via a base so as to form a U-shaped part, and in that a branch extends from said base such that the part takes the shape of a tuning fork.

13. The portable object according to claim 12, wherein the part includes at least two toothings each located on one of the horns of said part.

14. The portable object according to claim 12, wherein the part includes at least one toothing located on the branch of said part.

15. The portable object according to claim 12, wherein the part includes two toothings each located on the branch of said part.

* * * * *